United States Patent [19]

Drake

[11] 4,086,756

[45] May 2, 1978

[54] WRIST WATCH AND LIGHTER COMBINATION

[76] Inventor: Stephen Drake, 10 Standish Rd., Brentwood, N.Y. 11717

[21] Appl. No.: 729,653

[22] Filed: Oct. 5, 1976

[51] Int. Cl.[2] ..... G04B 37/12

[52] U.S. Cl. ..... 58/152 R; 431/253; 58/88 R

[58] Field of Search ..... 58/152 R, 53, 54, 55, 58/56, 88 R, 88 C, 88 G; D10/31, 30, 38; D48/27; 431/253, 269, 206, 221

[56] References Cited

U.S. PATENT DOCUMENTS

| | | | |
|---|---|---|---|
| 1,871,898 | 8/1932 | Manheimer | 431/253 X |
| 2,129,480 | 9/1938 | Schlacht | 58/152 R |
| 2,576,476 | 11/1951 | Peter et al. | 58/152 R |
| 2,577,679 | 12/1951 | Fraser | 431/253 X |
| 3,379,491 | 4/1968 | Houle | 431/253 X |
| 3,816,056 | 6/1974 | Brown | 431/253 |

*Primary Examiner*—Ulysses Weldon
*Attorney, Agent, or Firm*—Richard L. Miller

[57] ABSTRACT

A wrist watch is disclosed having a cigarette lighter incorporated along one side edge of the watch case; the cigarette lighter including an opening containing a lighter-fluid soaked cotton wad and a removable pin fitted with a likewise cotton wad, and steel material on the tip of the pin for being scratched on a flint surface on the outer side of the lighter.

3 Claims, 4 Drawing Figures

WRIST WATCH AND LIGHTER COMBINATION

This invention relates generally to instruments that are combined together in a single unit. More specifically, it relates to a wrist watch and a cigarette lighter.

A principal object of the present invention is to provide a wrist watch having a cigarette lighter incorporated therewith so that the lighter is readily handy whenever needed for lighting up a cigarette, so that the lighter, thus carried upon a wrist, eliminates the necessity of reaching into a pocket for the same.

Another object is to provide a wrist watch and lighter combination which accordingly would be ideal for use by a man while being seated and when it is more difficult to extract an object such as a lighter from a trousers pocket.

Still another object is to provide a wrist watch and lighter combination in which the lighter comprises only a small extension along one side edge of the watch case so that it remains small and not cumbersome.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
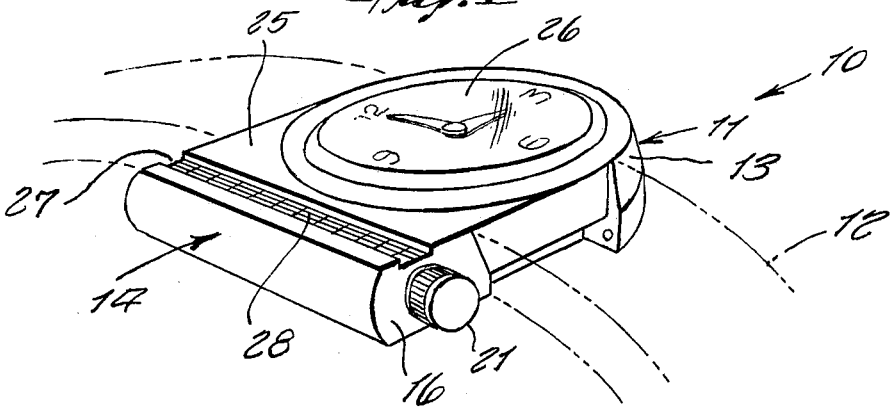
FIG. 1 is a perspective view of a design of the invention which is incorporated into the wrist watch case.
Figure 2:
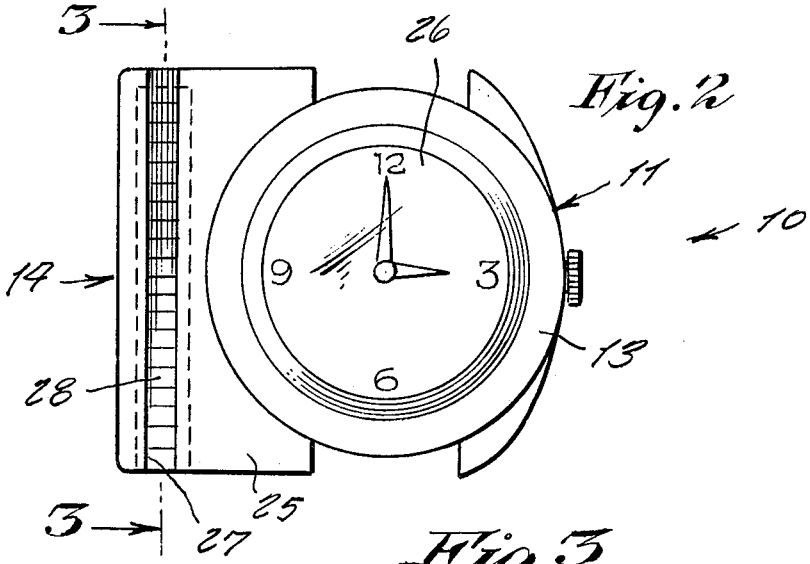
FIG. 2 is a top view of the invention shown with lighter pin removed therefrom.
Figure 3:
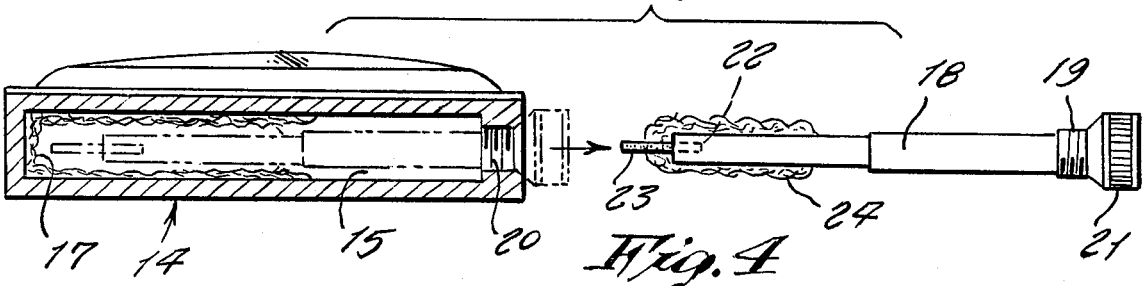
FIG. 3 is a cross-sectional view taken on line 3—3 of FIG. 2.

Referring now to the drawing now in greater detail, and more particularly to FIGS. 1 and 3 thereof at this time, the reference numeral 10 represents a wrist watch and lighter combination according to the present invention wherein there is a wrist watch 11 attachable to a wrist band 12 for being worn around a person's wrist in a conventional manner.

In the present invention, the watch has a watch case 13 which is enlarged slightly toward one side edge in order to incorporate a lighter 14 which includes an elongated pin receptacle opening 15 in the case 13 and which opens out on an end wall 16 that forms a lower side of the watch when the watch time is being read. The opening is lined with a cotton wad 17 that is saturated with a cigarette lighter fluid.

A metal pin 18 is removably inserted into the opening and is securable therein by a thread 19 on the pin engaging a screw thread 20 at the opening entrance. The pin includes an external, enlarged, knurled head 21 so to easily unscrew the pin and remove the same from the opening. The inner end of the pin has a drilled hole 22 in which there is frictionally fitted a steel tip 23 that protrudes outwardly of the hole. A wad of cotton 24 is wrapped around the inner portion of the pin, and extends around a base portion of the steel tip, the cotton wad 24 being likewise saturated with a lighter fluid.

Upon an upper side 25 of the case and which includes the watch face 26, there is provided a groove 27 extending across a full length of the lighter portion of the case, the bottom surface of the groove retaining a flint type material 28 or the like.

In operative use, the pin is simply removed from the pin receptacle opening and is held by the head 21 while the end of the steel tip is scratched across the flint surface 28 in the groove 27. Thus the flint produces a spark that ignites the cotton was 24 so to produce a flame that can be used to light a cigarette or the like.

Figure 4:
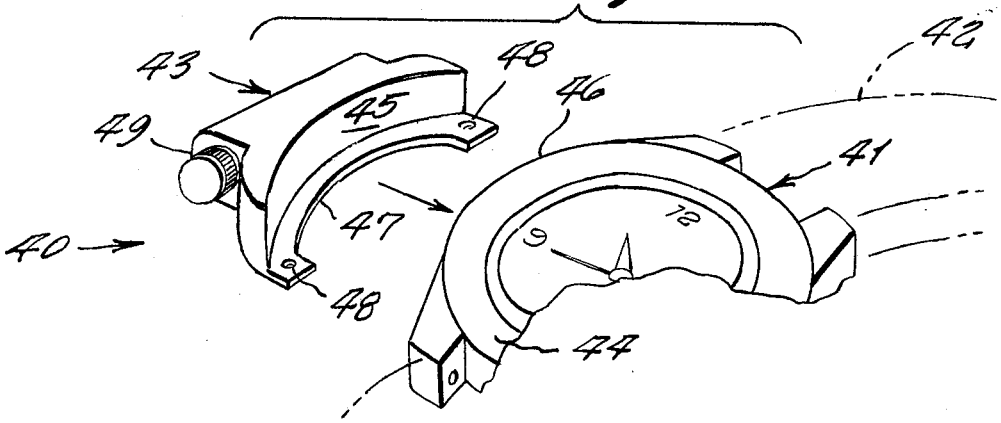
FIG. 4 is a perspective view of a modified design of the invention and which is attachable to a watch case.

In FIG. 4, a modified design 40 of the invention incorporates a watch 41 of conventional type supported by wrist band 42, and a separate lighter 43 that is attachable to the watch case 44. The lighter accordingly has a side 45 that conforms to a shape of a side 46 of the watch case so that when placed adjacent each other, the lighter and watch case form a harmonious shaped single unit. The lighter includes a flange 47 that fits in a corresponding recess on an underside of the watch case and which is securable thereto by screws fitted through openings 48 in the flange and into threaded openings in the watch case. The lighter includes the above described opening 15, pin 18 and cotton wads, as stated. The flint groove 27 may be on top as stated or else along a side edge 49 of the lighter case 50.

Thus a modified structure is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wrist watch and lighter combination, comprising a wrist watch and a lighter, said wrist watch being attachable to a wrist band for securement around a wearer's wrist; said watch having a watch mechanism for indicating a time of day, and said lighter having means to produce a flame for lighting a cigarette or cigar; said means for producing a flame comprising a pin receptacle opening, a metal pin removably secured in said opening, a cotton wad lining said opening and a second cotton wad wrapped around an inner end of said pin, said wads being saturated with a lighter fluid, and inner end of said pin having a steel tip protruding therefrom, and an outer side of said lighter having a flint surface for scratching said steel tip thereacross, said flint surface being along a bottom of a groove recessed on said lighter outer side.

2. The combination as set forth in claim 1 wherein said lighter includes a case that is integral with a case of said watch.

3. The combination as set forth in claim 1 wherein said lighter and said watch include separate cases that are attachable together by suitable securement means.

* * * * *